US011315719B2

(12) United States Patent
Yeo et al.

(10) Patent No.: US 11,315,719 B2
(45) Date of Patent: Apr. 26, 2022

(54) METHOD OF MANUFACTURING A COIL COMPONENT

(71) Applicant: SAMSUNG ELECTRO-MECHANICS CO., LTD., Suwon-si (KR)

(72) Inventors: Jeong Gu Yeo, Suwon-si (KR); Jae Hun Kim, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 658 days.

(21) Appl. No.: 16/213,893

(22) Filed: Dec. 7, 2018

(65) Prior Publication Data

US 2019/0311831 A1 Oct. 10, 2019

(30) Foreign Application Priority Data

Apr. 10, 2018 (KR) ..... 10-2018-0041462

(51) Int. Cl.

| | |
|---|---|
| ***H01F 7/06*** | (2006.01) |
| ***H01F 17/00*** | (2006.01) |
| ***H01F 17/04*** | (2006.01) |
| ***H01F 27/255*** | (2006.01) |
| ***H01F 41/04*** | (2006.01) |
| ***H01F 27/29*** | (2006.01) |

(52) U.S. Cl.

CPC ..... *H01F 17/0013* (2013.01); *H01F 17/04* (2013.01); *H01F 27/255* (2013.01); *H01F 27/292* (2013.01); *H01F 41/042* (2013.01); *H01F 41/046* (2013.01); *H01F 2017/048* (2013.01)

(58) Field of Classification Search

CPC .. H01F 27/255; H01F 27/292; H01F 17/0013; H01F 17/04; H01F 2017/048; H01F 41/046; H01F 41/042

See application file for complete search history.

(56) References Cited

U.S. PATENT DOCUMENTS 9,655,247 B1 * 5/2017 Yoon ..... H01F 41/041
9,786,424 B2 * 10/2017 Park ..... H01F 17/0013
(Continued)

FOREIGN PATENT DOCUMENTS

CN 102187408 A 9/2011
CN 104766715 A 7/2015
(Continued)

OTHER PUBLICATIONS

Chinese Office Action dated Mar. 26, 2021 issued in Chinese Patent Application No. 201910197372.0 (with English translation).
(Continued)

*Primary Examiner* — Paul D Kim
(74) *Attorney, Agent, or Firm* — Morgan, Lewis & Bockius LLP

(57) ABSTRACT

A manufacturing method of a coil component includes: forming a plating resist on an internal insulating layer; forming a coil pattern and a lead pattern connected to the coil pattern and at least partially having a thickness smaller than that of the coil pattern by plating; removing the plating resist; and stacking a magnetic sheet on the internal insulating layer to form a body.

10 Claims, 8 Drawing Sheets

(56) References Cited

U.S. PATENT DOCUMENTS

| | | | | |
|---|---|---|---|---|
| 9,972,436 | B2 * | 5/2018 | Hamada | H01F 5/00 |
| 10,332,667 | B2 | 6/2019 | Jeong et al. | |
| 10,614,943 | B2 | 4/2020 | Choi et al. | |
| 2007/0247268 | A1 * | 10/2007 | Oya | H01L 23/3128 336/200 |
| 2009/0278649 | A1 | 11/2009 | Tatsukawa et al. | |
| 2011/0187486 | A1 | 8/2011 | Sugiyama et al. | |
| 2015/0255208 | A1 * | 9/2015 | Kim | H01F 17/0006 336/200 |
| 2015/0270053 | A1 * | 9/2015 | Cha | C25D 5/02 336/192 |
| 2016/0172102 | A1 | 6/2016 | Jeong et al. | |
| 2016/0172103 | A1 | 6/2016 | Jeong et al. | |
| 2016/0268038 | A1 | 9/2016 | Choi | |
| 2016/0336105 | A1 | 11/2016 | Choi et al. | |

FOREIGN PATENT DOCUMENTS

| | | | |
|---|---|---|---|
| CN | 105702428 | A | 6/2016 |
| CN | 105957692 | A | 9/2016 |
| CN | 106158242 | A | 11/2016 |
| JP | 3856047 | B2 | 12/2006 |
| KR | 10-2015-0080737 | A | 7/2015 |
| KR | 10-1617124 | A | 4/2016 |
| KR | 10-2016-0071957 | A | 6/2016 |
| KR | 10-2016-0071958 | A | 6/2016 |
| KR | 10-2016-0132593 | A | 11/2016 |

OTHER PUBLICATIONS

Korean Office Action dated Jul. 18, 2019 issued in Korean Patent Application No. 10-2018-0041462 (with English translation).

Office Action issued in corresponding Chinese Patent Application No. 201910197372.0 dated Sep. 16, 2020, with English translation.

* cited by examiner

II - II'

III – III'

II - II'

II - II'

METHOD OF MANUFACTURING A COIL COMPONENT

CROSS-REFERENCE TO RELATED APPLICATION(S)

This application claims the benefit of priority to Korean Patent Application No. 10-2018-0041462 filed on Apr. 10, 2018 in the Korean Intellectual Property Office, the disclosure of which is incorporated herein by reference in its entirety.

BACKGROUND

1. Field

The present disclosure relates to a coil component and a method of manufacturing thereof.

2. Description of Related Art

An inductor, which is a type of coil component, is a representative passive element constituting an electronic circuit together with a resistor and a capacitor to remove noise.

A thin film type inductor may be manufactured by forming a coil pattern by plating, hardening a magnetic powder-resin composite in which magnetic powder particles and a resin are mixed with each other to manufacture a magnetic body, and forming external electrodes on outer surfaces of the magnetic body.

In accordance with recent trends toward increased complexation, multifunctionalization, slimness of a set, and further decreased thickness of the thin film type inductor as described above, research has been continuously conducted.

SUMMARY

An aspect of the present disclosure may provide a coil component and a method of manufacturing thereof capable of increasing binding force between a body and a coil part by forming a lead pattern to at least partially have a thickness smaller than that of a coil pattern.

According to an aspect of the present disclosure, a manufacturing method of a coil component may include: forming a plating resist on an internal insulating layer; forming a coil pattern and a lead pattern connected to the coil pattern and at least partially having a thickness smaller than that of the coil pattern by plating; removing the plating resist; and stacking a magnetic sheet on the internal insulating layer to form a body.

Here, the plating resist may include an opening pattern corresponding to the coil pattern and a hollow pattern corresponding to the lead pattern, being in communication with the opening pattern, and having an upper portion at least partially covered by a cover portion.

According to another aspect of the present disclosure, a coil component is obtained by the manufacturing method.

BRIEF DESCRIPTION OF DRAWINGS

The above and other aspects, features, and advantages of the present disclosure will be more clearly understood from the following detailed description taken in conjunction with the accompanying drawings, in which.

DETAILED DESCRIPTION

Figure 1:
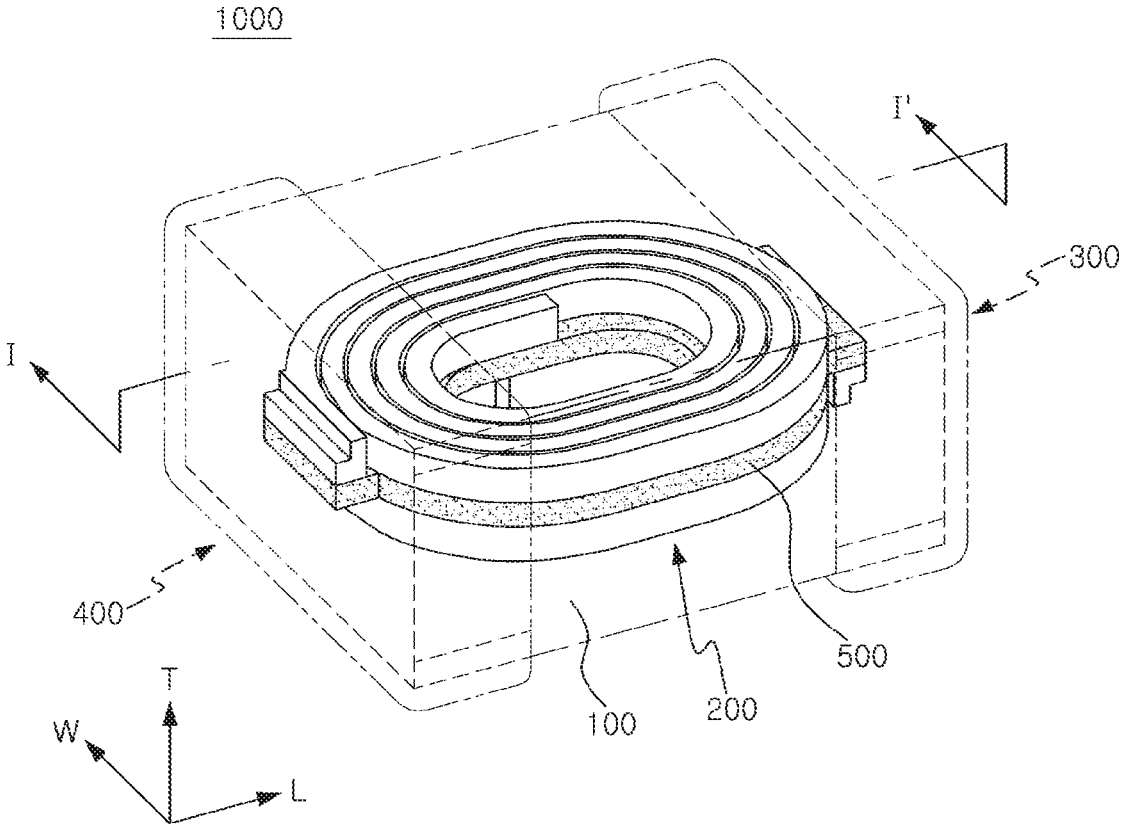
FIG. 1 is a perspective view schematically illustrating a coil component according to an exemplary embodiment in the present disclosure.

Hereinafter, exemplary embodiments of the present disclosure will now be described in detail with reference to the accompanying drawings.

In the accompanying drawings, an L direction refers to a first direction or a length direction, a W direction refers to a second direction or a width direction, and a T direction refers to a third direction or a thickness direction.

Hereinafter, a manufacturing method of a coil component according to an exemplary embodiment in the present disclosure will be described in detail with reference to the accompanying drawings. In describing an exemplary embodiment in the present disclosure with reference to the accompanying drawings, components that are the same as or correspond to each other will be denoted by the same reference numerals, and an overlapped description thereof will be omitted.

Coil Component

Figure 2:
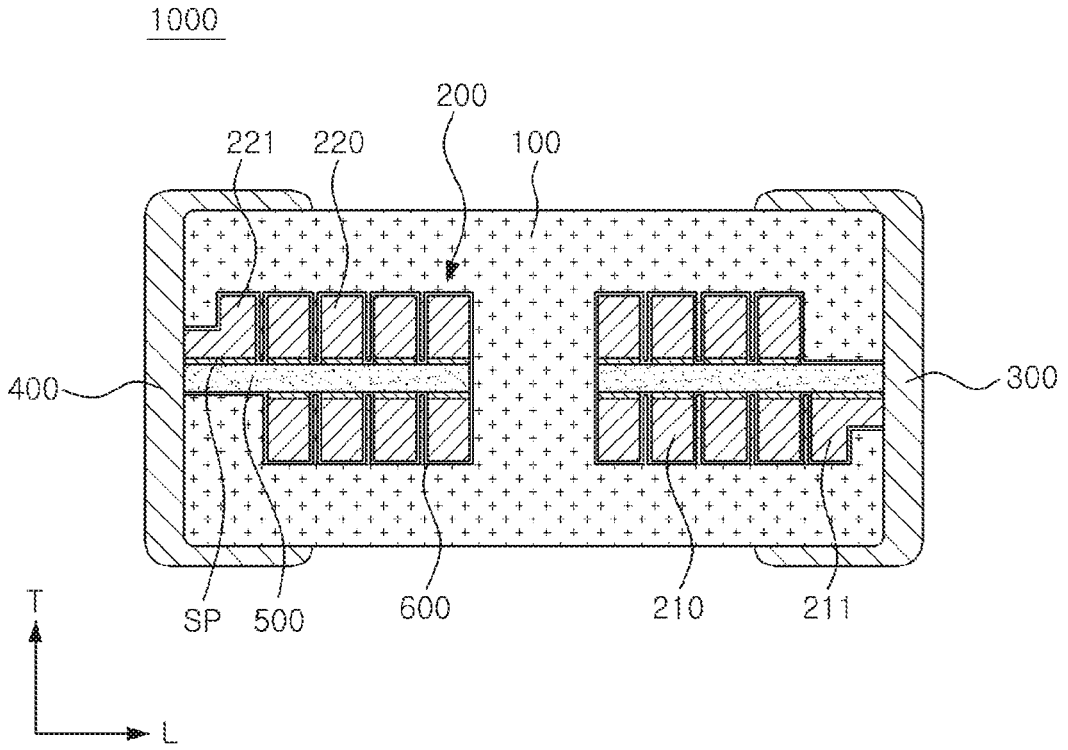
FIG. 2 is a cross-sectional view taken along line I-I' of FIG. 1.

FIG. 1 is a perspective view schematically illustrating a coil component according to an exemplary embodiment in the present disclosure. FIG. 2 is a cross-sectional view taken along line I-I' of FIG. 1.

Referring to FIGS. 1 and 2, a coil component 1000 according to the exemplary embodiment in the present disclosure may include a body 100, a coil part 200, external electrodes 300 and 400, an internal insulating layer 500, and an insulating film 600.

The body 100 may form an exterior of the coil component 1000 according to the present exemplary embodiment, and the coil part 200 may be embedded therein.

The body 100 may be formed in an entirely hexahedral shape.

Hereinafter, as an example, the first exemplary embodiment in the present disclosure will be described on the assumption that the body 100 has a hexahedral shape. However, a coil component including a body formed in a shape other than the hexahedral shape is not excluded in the scope of the present exemplary embodiment by the description.

The body 100 may have first and second surfaces opposing each other in the length (L) direction, third and fourth surfaces opposing each other in the width (W) direction, and fifth and sixth surfaces opposing each other in the thickness (T) direction. The first to fourth surfaces of the body 100 may correspond to wall surfaces of the body 100 connecting the fifth and sixth surfaces of the body 100 to each other. The wall surfaces of the body 100 may include the first and second surfaces corresponding to both end surfaces opposing each other and the third and fourth side surfaces corresponding to both side surfaces opposing each other.

For example, the body 100 may be formed so that the coil component 1000 in which external electrodes 300 and 400 to be described below are formed has a length of 2.0 mm, a width of 1.2 mm, and a thickness of 0.65 mm, but the body 100 is not limited thereto. Meanwhile, the above-mentioned numerical values of the length, the width, and the thickness of the coil component are values without considering tolerances and an actual length, an actual width, and an actual thickness of the coil component may be different from the numerical values described above by the tolerances.

The body 100 may contain a magnetic material and a resin. More specifically, the body may be formed by stacking one or more magnetic composite sheets (110 in FIG. 9) in which the magnetic material is dispersed in the resin. However, the body 100 may also have a different structure other than a structure in which the magnetic material is dispersed in the resin. For example, the body 100 may also be formed of a magnetic material such as ferrite.

The magnetic material may be ferrite or a metal magnetic powder.

As an example, the ferrite may be at least one selected from spinel type ferrite such as Mg—Zn based ferrite, Mn—Zn based ferrite, Mn—Mg based ferrite, Cu—Zn based ferrite, Mg—Mn—Sr based ferrite, and Ni—Zn based ferrite; hexagonal ferrite such as Ba—Zn based ferrite, Ba—Mg based ferrite, Ba—Ni based ferrite, Ba—Co based ferrite, and Ba—Ni—Co based ferrite; garnet type ferrite such as Y based ferrite; and Li based ferrite.

The metal magnetic powder may contain one or more selected from the group consisting of iron (Fe), silicon (Si), chromium (Cr), cobalt (Co), molybdenum (Mo), aluminum (Al), niobium (Nb), copper (Cu), and nickel (Ni). For example, the metal magnetic powder may be at least one of pure iron powder, Fe—Si based alloy powder, Fe—Si—Al based alloy powder, Fe—Ni based alloy powder, Fe—Ni—Mo based alloy powder, Fe—Ni—Mo—Cu based alloy powder, Fe—Co based alloy powder, Fe—Ni—Co based alloy powder, Fe—Cr based alloy powder, Fe—Cr—Si based alloy powder, Fe—Si—Cu—Nb based alloy powder, Fe—Ni—Cr based alloy powder, and Fe—Cr—Al based alloy powder.

The metal magnetic powder may be amorphous or crystalline. For example, the metal magnetic powder may be Fe—Si—B—Cr based amorphous alloy powder, but is not necessarily limited thereto.

The ferrite and the metal magnetic powder may each have an average diameter of about 0.1 μm to 30 μm, but are not limited thereto.

The body 100 may contain two or more kinds of magnetic materials dispersed in the resin. Here, the phrase "different kinds of magnetic materials" means that the magnetic materials dispersed in the resin are distinguished from each other in any one of an average diameter, a composition, crystallinity, and a shape thereof.

The resin may include one or a mixture of epoxy, polyimide, a liquid crystal polymer (LCP), and the like, but is not limited thereto.

The body 100 may include a core penetrating through a coil part 200 and an internal insulating layer 500 to be described below. The core may be formed by filling the magnetic composite sheet (110 in FIG. 9) in a through hole formed in the coil part 200 and the internal insulating layer 500, but is not limited thereto.

The coil part 200 may be embedded in the body 100 and exhibit characteristics of the coil component. For example, when the coil component 1000 is used as a power inductor, the coil part 200 may serve to stabilize a power source of an electronic device by storing an electric field as a magnetic field to maintain an output voltage.

The coil part 200 may include a first coil pattern 210, a second coil pattern 220, and a via (not illustrated).

The first and second coil patterns 210 and 220 and an internal insulating layer 500 to be described below may be formed to be sequentially stacked in the thickness (T) direction of the body 100.

Each of the first and second coil patterns 210 and 220 may be formed in a flat spiral shape. As an example, the first coil pattern 210 may form at least one turn on one surface of the internal insulating layer 500 centered on the thickness (T) direction of the body 100.

The via may penetrate through the internal insulating layer 500 so as to electrically connect the first and second coil patterns 210 and 220 to each other, thereby coming in contact with each of the first and second coil patterns 210 and 220. As a result, the coil part 200 applied to the present exemplary embodiment may be formed as a single coil generating a magnetic field in the thickness (T) direction of the body 100.

At least one of the first and second coil patterns 210 and 220 and the via may include at least one conductive layer.

As an example, when the second coil pattern 220 and the via are formed by plating, each of the second coil pattern 220 and the via may include a seed pattern SP of an electroless plating layer and a plating pattern of an electroplating layer. Here, the plating pattern of the electroplating layer may have a monolayer structure or a multilayer structure. The plating pattern having the multilayer structure may also be formed in a conformal film structure in which one plating pattern is covered with another plating pattern. Alternatively, the plating layer having the multilayer structure may also be formed so that only on one surface of one plating pattern, another plating pattern is stacked. The seed pattern SP of the second coil pattern 220 and the seed pattern of the via may be formed integrally with each other so that a boundary therebetween is not formed, but seed pattern SP of the second coil pattern 220 and the seed pattern of the via are not limited thereto. The plating pattern of the second coil pattern 220 and the plating pattern of the via may be formed integrally with each other so that a boundary therebetween is not formed, but the plating pattern of the second coil pattern 220 and the plating pattern of the via are not limited thereto.

As another example, when the coil part 200 is formed by separately forming the first and second coil patterns 210 and 220 and then collectively stacking the first and second coil patterns 210 and 220 on the internal insulating layer 500, the via may include a high-melting point metal layer and a low-melting point metal layer having a melting point lower than that of the high-melting point metal layer. Here, the low-melting point metal layer may be formed of solder containing lead (Pb) and/or tin (Sn). The low-melting point metal layer may be at least partially melted by a pressure and a temperature at the time of collective stacking, such that an inter-metallic compound (IMC) layer may be formed in a boundary between the low-melting point metal layer and the second coil pattern 220.

As an example, the first and second coil patterns 210 and 20 may be formed to protrude on lower and upper surfaces of the internal insulating layer 500, respectively. As another example, the first coil pattern 210 may be embedded in the lower surface of the internal insulating layer 500 so that a lower surface thereof is exposed to the lower surface of the internal insulating layer 500, and the second coil pattern 220 may be formed to protrude on the upper surface of the internal insulating layer 500. In this case, a concave portion may be formed in the lower surface of the first coil pattern 210, such that the lower surface of the internal insulating layer 500 and the lower surface of the first coil pattern 210 may not be positioned on the same plane. As another example, the first coil pattern 210 may be embedded in the lower surface of the internal insulating layer 500 so that the lower surface thereof is exposed to the lower surface of the internal insulating layer 500, and the second coil pattern 220 may be embedded in the upper surface of the internal insulating layer 500 so that an upper surface thereof is exposed to the upper surface of the internal insulating layer 500.

The first and second coil patterns 210 and 220 may be connected to the lead patterns 211 and 221 exposed to the first and second surfaces of the body 100, respectively. That is, the end portion of the first coil pattern 210 may be connected to a first lead pattern 211 exposed to the first surface of the body 100, and the end portion of the second coil pattern 220 may be connected to a second lead pattern 221 exposed to the second surface of the body 100. Since the first lead pattern 211 comes in contact with a first external electrode 300 to be described below, the first coil pattern 210 and the first external electrode 300 may be electrically connected to each other. Since the second lead pattern 221 comes in contact with a second external electrode 400 to be described below, the second coil pattern 220 and the second external electrode 400 may be electrically connected to each other.

The lead patterns 211 and 221 may be formed to entirely have a thickness smaller than that of the coil patterns 210 and 220 or formed to at least partially have a thickness smaller than that of the coil patterns 210 and 220, respectively. The portions of the lead pattern 211 and 221 having a thickness smaller than that of the coil patterns 210 and 220 may be disposed adjacent to the first and second external electrodes 300 and 400, and may be in direct contact with the first and second external electrodes 300 and 400.

As an example, as illustrated in FIG. 2, groove portions may be formed on some regions of the lead patterns 211 and 221 so that some portions of the lead patterns 211 and 221 at least partially have a smaller thickness than that of the coil patterns 210 and 220. For example, some portions of the lead patterns 211 and 221 may have a thickness less than or equal to 0.6× the thickness of the coil patterns 210 and 220.

Since the lead patterns 211 and 221 are formed to at least partially have a thickness smaller than that of the coil patterns 210 and 220, binding force between the magnetic composite sheet 100 and the coil part may be improved. Therefore, binding force between the coil part 200 and the body 100 may be improved. Further, since the lead patterns 211 and 221 are formed to at least partially have a thickness smaller than that of the coil patterns 210 and 220, a total amount of a magnetic material in the same volume may be increased as compared to a case in which the groove portions are not formed in the lead patterns 211 and 221. Therefore, a quality (Q) factor of the coil component 1000 may be improved.

The coil patterns 210 and 220, the lead patterns 211 and 221, and the via may each be formed of a conductive material such as copper (Cu), aluminum (Al), silver (Ag), tin (Sn), gold (Au), nickel (Ni), lead (Pb), titanium (Ti), or alloys thereof, but are not limited thereto.

The internal insulating layer 500 may be formed of an insulating material including at least one of thermosetting insulating resins such as an epoxy resin, thermoplastic insulating resins such as polyimide, and photosensitive insulating resins, or an insulating material in which a reinforcing material such as glass fiber or an inorganic filler is impregnated in this insulating resin. As an example, the internal insulating layer 500 may be formed of an insulating material such as prepreg, an Ajinomoto build-up film (ABF), FR-4, a bismaleimide triazine resin, a photoimageable dielectric (PID), or the like, but is not limited thereto.

As the inorganic filler, at least one selected from the group consisting of silica ($SiO_2$), alumina ($Al_2O_3$), silicon carbide (SiC), barium sulfate ($BaSO_4$), talc, mud, mica powder, aluminum hydroxide ($AlOH_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the internal insulating layer 500 is formed of an insulating material containing a reinforcing material, the internal insulating layer 500 may provide more excellent rigidity. When the internal insulating layer 500 is formed of an insulating material that does not contain glass fiber, the internal insulating layer 500 is advantageous for thinning a thickness of the entire coil part 200. When the internal insulating layer 500 is formed of an insulating material containing a photosensitive insulating resin, the number of processes may be decreased, which is advantageous for decreasing a manufacturing cost, and a fine hole may be formed.

The insulating film 600 may be formed along surfaces of the first coil pattern 210, the internal insulating layer 500, and the second coil pattern 220. The insulating film 600 may be formed in order to protect and insulate the respective coil patterns 210 and 220 and contain an insulating material known in the art such as parylene, or the like. Any insulating material may be contained in the insulating film 600 without particular limitation. The insulating film 600 may be formed by a method such as a vapor deposition method, but is not limited thereto. The insulating film 600 may be formed by stacking an insulation film on both surfaces of the internal insulating layer 500 on which the first and second coil patterns 210 and 220 are formed.

Meanwhile, although not illustrated, at least one of the first and second coil patterns 210 and 220 may be formed in plural. As an example, the coil part 200 may have a structure in which a plurality of first coil patterns 210 are formed, and another first coil pattern is stacked on a lower surface of one first coil pattern. In this case, an additional insulating layer may be disposed between the plurality of first coil patterns 210, and the plurality of first coil patterns 210 may be connected to each other by a connection via penetrating through the additional insulating layer, but the first coil pattern 210 is not limited thereto.

The external electrodes 300 and 400 may be disposed on one surface of the body 100 and connected to the coil patterns 210 and 220. The external electrodes 300 and 400 may include a first external electrode 300 connected to the first coil pattern 210 and a second external electrode 400 connected to the second coil pattern 220. More specifically, the first external electrode 300 may include a first connection portion disposed on the first surface of the body 100 and connected to the first lead pattern 211 of the first coil pattern 211 and a first extension portion extended from the first connection portion to the sixth surface of the body 100. The second external electrode 400 may include a second connection portion disposed on the second surface of the body 100 and connected to the second lead pattern 221 of the second coil pattern 220 and a second extension portion extended from the second connection portion to the sixth surface of the body 100. The first and second extension portions each disposed on the sixth surface of the body 100 may be spaced apart from each other so that the first and second external electrodes 300 and 400 do not come in contact with each other.

The external electrodes 300 and 400 may electrically connect the coil component 1000 to a printed circuit board, or the like, when the coil component 1000 according to the present exemplary embodiment is mounted on the printed circuit board, or the like. As an example, the coil component 1000 according to the present exemplary embodiment may be mounted on the printed circuit board so that the sixth surface of the body 100 faces an upper surface of the printed circuit board, and the extension portions of the external electrodes 300 and 400 disposed on the sixth surface of the body 100 and a connection portion of the printed circuit board may be electrically connected to each other by solder, or the like.

The external electrodes 300 and 400 may include conductive resin layers and conductive layers formed on the conductive resin layers, respectively. The conductive resin layer may be formed by printing a paste, or the like, and may contain one or more conductive metals selected from the group consisting of copper (Cu), nickel (Ni), and silver (Ag), and a thermosetting resin. The conductive layer may contain one or more selected from the group consisting of nickel (Ni), copper (Cu), and tin (Sn), and be formed, for example, by plating.

Meanwhile, in the above-mentioned exemplary embodiments in the present disclosure, a description is provided on the assumption that the external electrodes 300 and 400 applied to the present disclosure are "L"-shaped electrodes composed of the connection portions and the extension portions, but this is only for convenience of explanation. Therefore, shapes of the external electrodes 300 and 400 may be variously changed. As an example, the external electrodes 300 and 400 are not formed on the first and second surfaces of the body 100 but may be formed only the sixth surface of the body 100 to thereby be connected to the coil part 200 through a via electrode, or the like. As another example, the external electrodes 300 and 400 may be "⊏"-shaped electrodes including connection portions respectively formed on the first and second surfaces of the body 100, extension portions extended from the connection portions and disposed on the sixth surface of the body, and band portions extended from the connection portions and disposed on the fifth surface of the body 100, respectively. As another example, the external electrodes 300 and 400 may be five-face electrodes including connection portions formed on the first and second surfaces of the body 100, extension portions extended from the connection portions and disposed on the sixth surface of the body, and band portions extended from the connection portions and disposed on the third to fifth surfaces of the body 100, respectively.

Manufacturing Method of Coil Component

FIGS. 3 through 9 are views sequentially illustrating a manufacturing method of the coil component according to an exemplary embodiment in the present disclosure.

Referring to FIGS. 3 through 9, the method of manufacturing the coil component according to the present exemplary embodiment in the present disclosure may include: forming a plating resist on an internal insulating layer; forming a coil pattern and a lead pattern connected to the coil pattern and at least partially having a thickness smaller than that of the coil pattern by plating; removing the plating resist; and stacking a magnetic sheet on the internal insulating layer to form a body. Here, the plating resist may include an opening pattern corresponding to the coil pattern and a hollow pattern corresponding to the lead pattern, being in communication with the opening pattern, and having an upper portion at least partially covered by a cover portion.

Although a case in which a process for forming a second coil pattern 220 and a second lead pattern 221 is performed only on an upper surface of an internal insulating layer 500 is illustrated in FIGS. 3 through 9, this case is illustrated by way of example for convenience of explanation. Therefore, it should be considered that although not illustrated in FIGS. 3 through 9, a process for forming the first coil pattern 210 and the first lead pattern 211 described above is equally performed on a lower surface of the internal insulating layer 500 in each step.

Further, although a case in which the process is performed in units of a single component size is illustrated in FIGS. 3 through 9, a process to be described below may also be performed in units of a panel or strip rather than units of the component.

Figure 3:
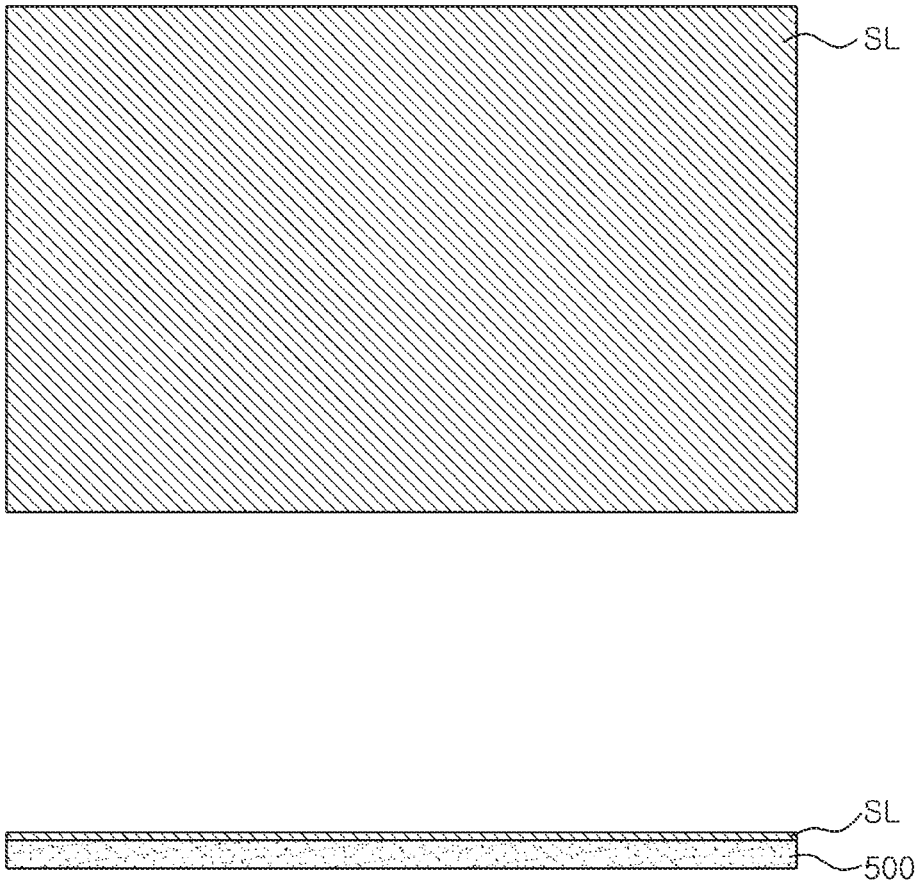
FIGS. 3 through 9 are views sequentially illustrating a manufacturing method of the coil component according to an exemplary embodiment in the present disclosure.

First, referring to FIG. 3, a seed layer may be formed on the internal insulating layer.

As an example, a seed layer SL may be an electroless plating layer formed on an upper surface of the internal insulating layer 500. As another example, the seed layer SL may be a metal film formed on one surface of the internal insulating layer 500 and an electroless plating layer formed on the metal film. As another example, the seed layer SL may be a copper film formed on one surface of the internal insulating layer 500.

Figure 4:
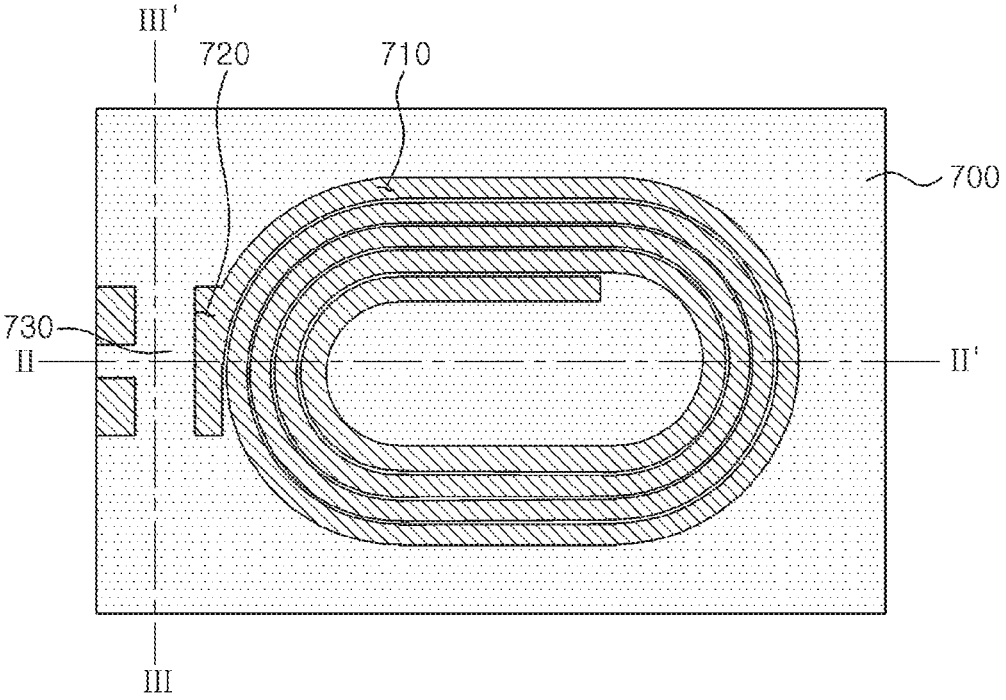
Figure 4:
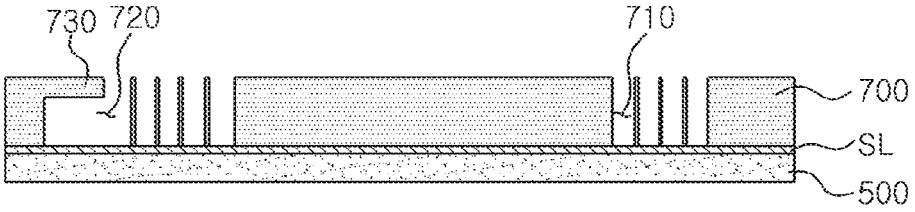
Figure 5:
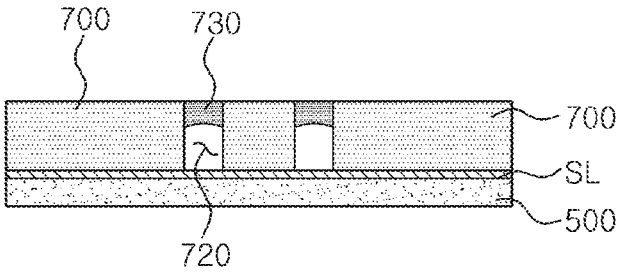

Next, referring to FIGS. 4 and 5, a plating resist may be formed on the internal insulating layer on which the seed layer is formed.

A plating resist 700, which is a material for forming the second coil pattern 220 and the second lead pattern 221 on the upper surface of the internal insulating layer, may be formed by stacking a material for forming a plating resist such as a dry film on the seed layer SL, and selectively performing exposure and development on the material for forming a plating resist.

The plating resist 700 may include an opening pattern 710 formed at a position corresponding to the second coil pattern 220 and a hollow pattern 720 formed at a position corresponding to the second lead pattern 221. The hollow pattern 720 may be in communication with the opening pattern 710 and be at least partially covered by a cover portion 730. The cover portion 730 extends parallel to the surface of the insulating substrate and is spaced apart from the insulating substrate 500.

An example of a formation method of the plating resist 700 including the opening pattern 710 and the hollow pattern 720 will be described.

First, a negative type dry film may be stacked on an entire surface of the seed layer SL. Next, a first exposure mask of which regions corresponding to the positions of the opening pattern 710 and the hollow pattern 720 are blocked and the other region is opened may be disposed on the dry film, and then the dry film may be subjected to primary exposure. Next, a second exposure mask of which the region corresponding to the position of the hollow pattern 720 is opened and the other region is blocked may be disposed on the dry film, and then the dry film may be subjected to secondary exposure. Finally, the dry film may be subjected to development, such that the plating resist 700 including the opening pattern 710 and the hallow pattern 720 may be formed.

Here, since one region of the dry film on which the opening pattern 710 will be formed is a region that is not exposed in the primary exposure and secondary exposure, when this region is subjected to development, this region may become the opening pattern 710. Further, the secondary exposure may be performed on another region of the dry film on which the hollow pattern 720 will be formed, but exposure energy may be adjusted so that light is transferred only to an upper portion of the dry film in a thickness direction. Therefore, when development is performed after the secondary exposure, the hollow pattern 720 on which the cover portion 730 that is cured in the secondary exposure and is not removed by development is formed may be formed. Primary exposure energy and secondary exposure energy may be 1700 mJ/cm$^2$ and 150 mJ/cm$^2$, respectively, but are not limited thereto. The primary exposure energy and the secondary exposure energy may be changed depending on a material and a thickness of the dry film.

Meanwhile, although a description is provided on the assumption that the dry film is the negative type dry film, this case is only an example. Therefore, a case of using a positive type dry film is not excluded in the scope of the present disclosure.

Figure 6:
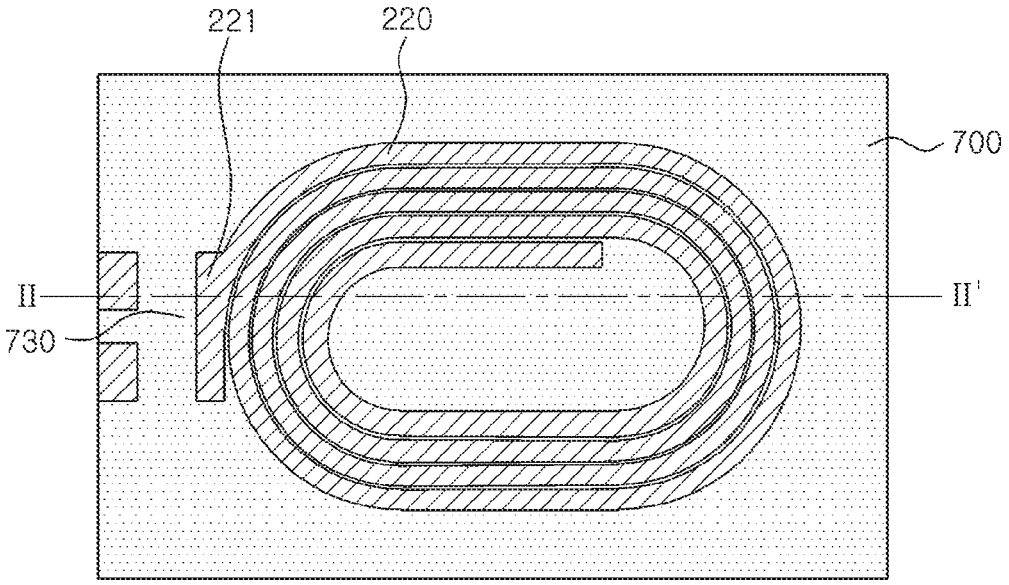
Figure 6:
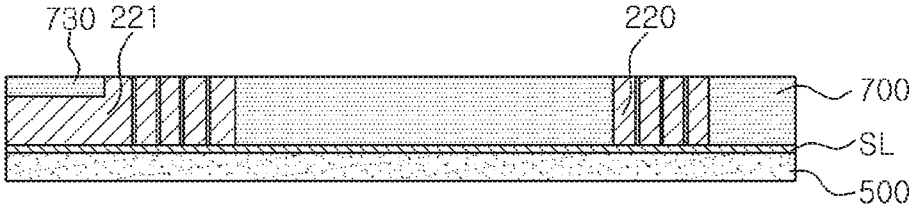

Next, referring to FIG. 6, the coil pattern and the lead pattern may be formed.

The second coil pattern 220 and the second lead pattern 221 may be formed by filling the opening pattern 710 and the hollow pattern 720 of the plating resist 700 with a conductive material, respectively. The second coil pattern 220 and the second lead pattern 221 may be formed by electroplating using the seed layer SL as a plating lead line. Here, the electroplating may be performed using an anisotropic plating solution, but is not limited thereto. When the electroplating is performed using an anisotropic plating solution, the second coil pattern 220 may be formed to have a relatively high aspect ratio.

As described above, since the upper portion of the hollow pattern 720 may be at least partially covered by the cover portion 730, the second lead pattern 221 may be formed to at least partially have a thickness smaller than that of the coil pattern 220.

Figure 7:
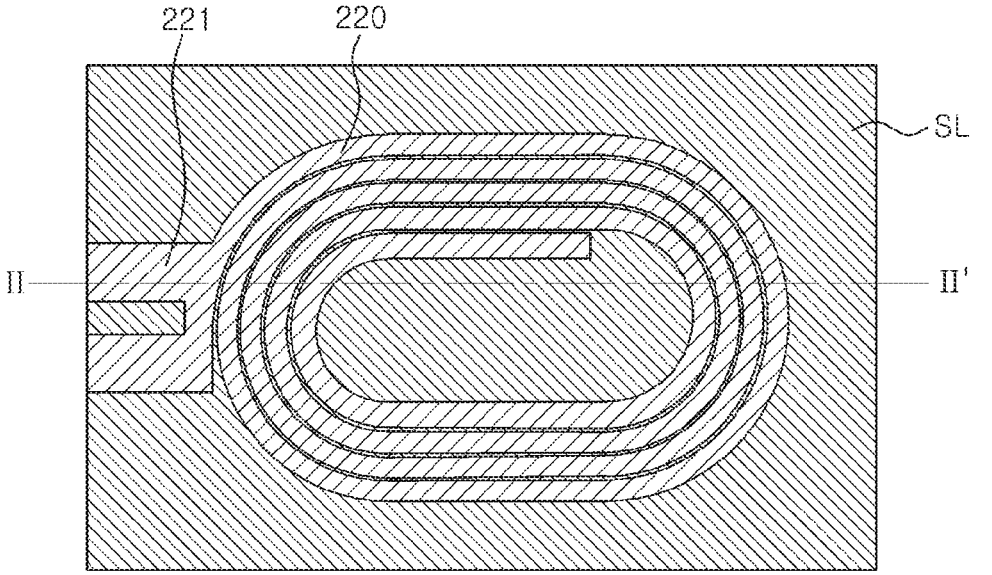
Figure 7:
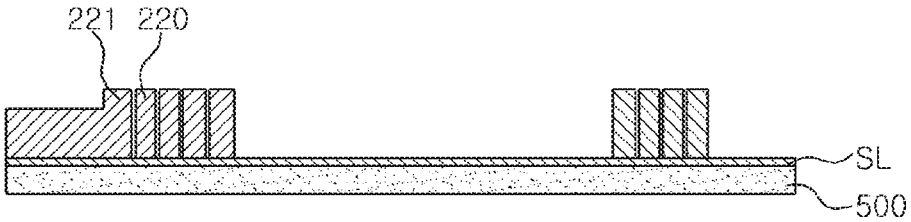
Figure 8:
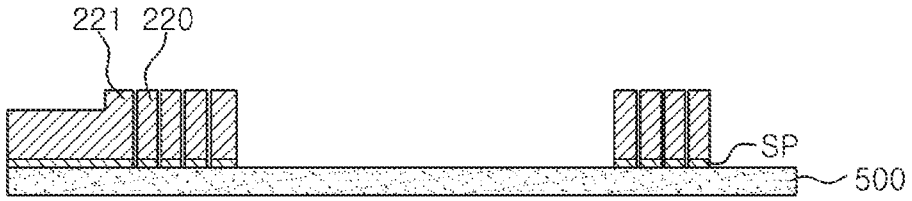

Next, referring to FIGS. 7 and 8, after removing the plating resist, the seed layer may be selectively removed.

The plating resist 700 may be stripped from the seed layer SL using a stripper.

When the plating resist 700 is removed, the seed layer SL may be exposed to the outside, and a region of the seed layer SL that is not covered by the second coil pattern 220 and the second lead pattern 221 may be selectively removed, such that a seed pattern SP may be formed between the second coil pattern 220 and the second lead pattern 221 and the internal insulating layer 500.

The seed pattern SP may be formed by performing flash etching, or the like, on the seed layer SL, but is not limited thereto.

Figure 9:
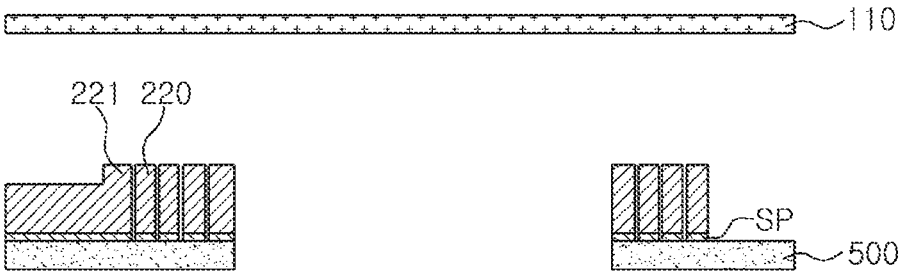

Next, referring to FIG. 9, a magnetic sheet may be stacked on the internal insulating layer.

A through hole may be formed in the internal insulating layer 500 by removing a central portion of the internal insulating layer 500 on which the second coil pattern 220 and the second lead pattern 221 are not formed.

A magnetic sheet 110 may be the above-mentioned magnetic composite sheet 110, but is not limited thereto.

Meanwhile, although a case in which one magnetic sheet 110 is stacked is illustrated in FIG. 9, this case is only an example. Therefore, the magnetic sheets 110 may be stacked in two or more layers on the internal insulating layer 500.

In this way, the body 100 and the coil part 200 illustrated in FIGS. 1 and 2 may be formed.

Further, although not illustrated in FIG. 9, before stacking the magnetic sheet 110 on the internal insulating layer 500 or forming the through hole in the internal insulating layer 500, the insulating film 600 illustrated in FIG. 2 may be formed along the surfaces of the coil patterns 210 and 220, the lead patterns 211 and 221, and the internal insulating layer 500.

Thereafter, although not illustrated, external electrodes 300 and 400 may be formed on first and second surfaces of the body 100, respectively.

Meanwhile, hereinabove, a description is provided on the assumption that the seed pattern SP is formed by selectively removing the seed layer SL after entire forming the seed layer SL on one surface of the internal insulating layer 500, but the seed pattern SP may be formed on one surface of the internal insulating layer 500 to correspond to the second coil pattern 220 and the second lead pattern 221 using a separate resist pattern before forming the plating resist 700.

As set forth above, according to exemplary embodiments in the present disclosure, the coil component in which binding force between the body and the coil part is improved by forming the lead pattern to at least partially have a thickness smaller than that of the coil pattern may be provided.

While exemplary embodiments have been shown and described above, it will be apparent to those skilled in the art that modifications and variations could be made without departing from the scope of the present invention as defined by the appended claims.

What is claimed is:

1. A method of manufacturing a coil component, the method comprising:

forming a plating resist on an internal insulating layer;

forming a coil pattern and a lead pattern connected to the coil pattern by plating, wherein at least a portion of the lead pattern has a thickness smaller than that of the coil pattern;

removing the plating resist; and stacking a magnetic sheet on the internal insulating layer to form a body, wherein the plating resist includes:

an opening pattern corresponding to the coil pattern;

a hollow pattern corresponding to the lead pattern and being in communication with the opening pattern; and a cover portion at least partially covering the hollow pattern.

2. The manufacturing method of claim 1, wherein the cover portion extends parallel to a surface of the internal insulating layer and is spaced apart from the internal insulating layer.

3. The manufacturing method of claim 2, wherein the forming of the plating resist includes:

stacking a dry film on the internal insulating layer; and performing exposure on the dry film several times while changing an exposure region.

4. The manufacturing method of claim 3, wherein the performing of exposure on the dry film several times includes:

performing exposure on a first region of the dry film using a first exposure energy; and performing exposure on a second region of the dry film using a second exposure energy lower than the first exposure energy.

5. The manufacturing method of claim 1, further comprising, before the forming of the plating resist on the internal insulating layer, forming a seed layer on the internal insulating layer.

6. The manufacturing method of claim 5, further comprising, after the removing of the plating resist, selectively removing the seed layer so as to form a seed pattern corresponding to the coil pattern and the lead pattern.

7. The manufacturing method of claim 1, wherein the forming of the plating resist on the internal insulating layer includes:

forming a seed pattern corresponding to the coil pattern and the lead pattern on the internal insulating layer; and forming the plating resist on the internal insulating layer on which the seed pattern is formed.

8. The manufacturing method of claim 7, wherein the forming of the coil pattern and the lead pattern by plating is performed by an anisotropic plating.

9. The manufacturing method of claim 1, wherein the forming of the coil pattern and the lead pattern by plating is performed by an anisotropic plating.

10. A method of manufacturing a coil component, the method comprising:

forming a plating resist on an internal insulating layer;

forming a coil pattern and a lead pattern connected to the coil pattern by plating, wherein at least a portion of the lead pattern has a thickness smaller than that of the coil pattern;

removing the plating resist; and stacking a magnetic sheet on the internal insulating layer to form a body, wherein the forming of the plating resist on the internal insulating layer includes:

forming a seed pattern corresponding to the coil pattern and the lead pattern on the internal insulating layer; and forming the plating resist on the internal insulating layer on which the seed pattern is formed.

* * * * *